US012637856B1

(12) United States Patent
Mathur

(10) Patent No.: US 12,637,856 B1
(45) Date of Patent: May 26, 2026

(54) META MATERIAL THERMAL SHIELD

(71) Applicant: Gopal Prasad Mathur, Trabuco Canyon, CA (US)

(72) Inventor: Gopal Prasad Mathur, Trabuco Canyon, CA (US)

(73) Assignee: METATHERM LLC, N Miami Beach, FL (US)

( * ) Notice: Subject to any disclaimer, the term of this patent is extended or adjusted under 35 U.S.C. 154(b) by 0 days.

(21) Appl. No.: 19/372,517

(22) Filed: Oct. 29, 2025

(51) Int. Cl.
*E04B 1/76* (2006.01)
*E04B 1/74* (2006.01)
*E04B 1/80* (2006.01)

(52) U.S. Cl.
CPC ..... *E04B 1/7654* (2013.01); *E04B 1/80* (2013.01); *E04B 2001/742* (2013.01)

(58) Field of Classification Search
CPC ..... Y10T 428/12382; Y10T 428/1241; Y10T 428/12493; Y10T 428/12535; Y10T 428/12542; Y10T 428/12556; Y10T 428/12562; Y10T 428/12632; Y10T 428/24942; Y10S 428/92; B32B 1/00; B32B 7/00; B32B 7/02; B32B 7/027; B32B 15/00; B32B 15/04; B32B 15/043; B32B 15/08; B32B 2250/04; B32B 2250/05; B32B 2419/00; B32B 2607/00; E04B 1/00; E04B 1/02; E04B 1/08; E04B 1/12; E04B 1/14; E04B 1/62; E04B 1/74; E04B 2001/742; E04B 1/76; E04B 1/7675; E04B 2001/7679; E04B 1/78; E04B 1/80; E04B 1/88; E04B 1/90; E04B 2/00; E04B 2/72; E04B 2103/02; E04B 2103/06; E04C 2/00; E04C 2/02; E04C 2/08; E04C 2/10; E04C 2/20; E04C 2/24; E04C 2/243; E04C 2/26; E04C 2/284; E04C 2/292; E04C 2/296; E04C 2/30; E04C 2/44; E04C 2/246
USPC ..... 428/599, 603, 615, 621, 622, 624, 625, 428/626, 635, 212, 920; 52/309.1, 52/309.13, 309.14, 309.15, 506.01
See application file for complete search history.

(56) References Cited

U.S. PATENT DOCUMENTS 4,700,521 A * 10/1987 Cover ..... B32B 15/14 52/404.3
9,982,430 B2 5/2018 Leonard
2008/0034698 A1 2/2008 Gupta

OTHER PUBLICATIONS

K. P. Vemuri, F. M. Canbazoglu, and P. R. Bandaru, "Guiding conductive heat flux through thermal meta materials." Applied Physics Letters 105, 193904 (2014); doi: 10.1063/1.4901885.

* cited by examiner

*Primary Examiner* — Maria V Ewald
*Assistant Examiner* — Ethan A. Utt
(74) *Attorney, Agent, or Firm* — Michael J. Feigin, Esq.; Feigin and Fridman LLC

(57) ABSTRACT

A meta material anisotropic, thermal insulation shield, designed to significantly improve performance of the thermal insulation by controlling path of heat flux passing through the system. Meta material techniques to enhance the thermal performance of insulating materials using thermal cloaking and/or heat flux rotation are disclosed. Meta material thermal insulating shield is implemented using anisotropic thermal insulation system comprising of rotated periodic layers of contrasting materials and thermal cloaks. Meta material insulation system can provide a system with thermal conductivity, which is much lower than the traditional systems. In other words, a meta material thermal insulation (Continued)

system having a much lower U-value than a traditional thermal insulation system can be designed.

22 Claims, 8 Drawing Sheets

$$\dot{Q} = kA\frac{T_1 - T_2}{L}$$

META MATERIAL THERMAL SHIELD

FIELD OF THE DISCLOSED TECHNOLOGY

This application relates to thermal shields/barriers using meta material concepts. More specifically, the disclosed technology is related to creating novel thermal insulation system (e.g., drywall and insulation) by incorporating meta material principles and to design a thermal shield which will significantly affect heat flow through it.

BACKGROUND OF THE DISCLOSED TECHNOLOGY

Insulation is crucial for maintaining a comfortable and energy-efficient home. It helps regulate temperature, reduces energy consumption, and can also improve soundproofing. By acting as a thermal barrier, drywall insulation minimizes heat transfer, keeping your home cooler in the summer and warmer in the winter. It involves the use of materials and techniques designed to reduce the transfer of heat between the inside and outside of a building.

One of the primary benefits of thermal insulation is enhanced energy efficiency. Buildings with adequate insulation require less energy for heating in the winter and cooling in the summer. Thermal insulation helps maintain a stable indoor temperature by minimizing the loss or gain of heat. As a result, homeowners and businesses can enjoy lower utility bills and reduce their reliance on fossil fuels, contributing to energy conservation.

The environmental benefits of thermal insulation cannot be overstated. By reducing energy consumption, insulation helps lower greenhouse gas emissions, which are a major contributor to climate change. Buildings account for a significant portion of global energy use and carbon dioxide emissions, so improving insulation in new and existing structures is a crucial step toward mitigating environmental impact.

Thermal shielding in data centers is crucial for maintaining optimal operating temperatures and preventing overheating. The shielding involves a combination of physical barriers, airflow management, and advanced cooling systems to isolate and remove heat. This includes using hot aisle/cold aisle containment, advanced insulation, and various cooling technologies.

A large drawback with housing such large quantities of servers is overheating. Vast amounts of heat are generated from computer servers, which could easily lead to overheating. A controlled environment helps avoid data server meltdown and protects the files stored from data loss or damage.

Data centers, due to their continuous operation and extensive IT and cooling infrastructure, require substantial and ever-increasing amounts of energy. The Electric Power Research Institute (EPRI) estimates that data centers could consume up to 9% of U.S. electricity generation annually by 2030, up from 4.4% of total electricity demand in 2023.

Regulating a data center's internal temperature can be best achieved with proper insulation. Keeping cool air from escaping through the roof and walls and even insulating emergency power rooms within a data center are exceedingly helpful to a smoothly running center. Proper insulation not only protects important data servers but also reduces energy costs. Since as much as 40% of a company's total operational costs for a data center can come from the energy needed to cool the building and the giant servers, choosing the correct insulation is crucial.

Thermal insulation materials have several key properties that make them effective in reducing heat transfer. The main properties are: (i) Thermal Conductivity: This is the measure of a material's ability to conduct heat. Lower thermal conductivity means better insulation. Common insulating materials, like fiberglass and foam, have low thermal conductivity. (ii) R-Value: This is a measure of the material's resistance to heat flow. Higher R-values indicate better insulating properties. The R-value depends on the type of insulation, its thickness, and its density. (iii) Density: The density of the insulation material affects its thermal performance. Higher-density materials typically provide better insulation but may also be heavier and more difficult to install. (iv) Fire Resistance: Some insulation materials are treated with fire retardants to reduce their flammability. Fire-resistant materials are crucial for safety in building construction. (v) Sound Insulation: While primarily used for thermal purposes, some insulation materials also provide soundproofing benefits by absorbing and dampening sound.

There are several common thermal insulation materials, each with their own unique properties and applications. Some of the most widely used ones are: Fiberglass, Foam Board or Rigid Foam, Spray Foam Insulation, Cellulose, Mineral Wool (i.e., Rock Wool, etc.), Aerogel. Each of these materials has specific advantages and is suited for different types of buildings and climates. Choosing the right insulation material depends on factors such as the specific application, budget, and desired thermal performance.

Improving the thermal conductivity of insulation is generally challenging. Here are some of the key obstacles faced in this endeavor: (i) Material Limitations-Intrinsic Properties: Many traditional insulation materials have intrinsic thermal properties that are difficult to enhance significantly without compromising other important characteristics. (ii) Trade-offs: Enhancing thermal conductivity might lead to undesirable trade-offs, such as increased weight, reduced flexibility, or higher costs. (iii) Complex Processes: Developing advanced insulation materials often involves complex manufacturing processes that can be difficult to change and/or scale up for mass production.

Thermal conductivity k [W/m·K] is a measure of a material's ability to conduct heat. The thermal conductivity is defined as the rate of heat transfer through a unit thickness of material per unit area per unit temperature difference. Thermal conductivity changes with temperature and is determined through experiments. An isotropic material is a material that has uniform properties in all directions. Thermal insulators are materials used primarily to provide resistance to heat flow.

The relationship between the R (thermal resistance)-value and k (thermal conductivity)-value is that they are inversely proportional to each other. This means that the higher the R-value, the lower the k-value, and vice versa. The R-value measures the thermal resistance of a material, while the k-value measures the thermal conductivity of a material. Thermal resistance is the ability of a material to resist heat flow, while thermal conductivity is the ability of a material to conduct heat. A material with a high R-value and a low k-value is a good insulator, while a material with a low R-value and a high k-value is a poor insulator. The formula that relates the R-value and k-value is $R=d/k$, where d is the thickness of the material.

Thermally insulating materials are designed to have low thermal conductivity, which means they slow down the rate of heat transfer. These materials typically contain air pockets or fibrous structures that inhibit the direct flow of heat. For a wall with insulation made of fiberglass blankets, the fiberglass fibers and the air trapped between them work together to reduce the flow of heat from the warm interior of the house to the colder exterior, or vice versa. The efficiency of this process is measured by the material's R-value, with higher R-values indicating better resistance to heat transfer.

Energy efficient smart buildings integrate advanced technologies to improve energy efficiency, occupant comfort, and overall building performance. Insulation plays a crucial role in achieving these goals. High-quality insulation reduces heat transfer, keeping buildings warmer in winter and cooler in summer. This leads to significant energy savings, as heating and cooling systems don't have to work as hard. Insulation is a key component in the design and operation of smart buildings. It enhances energy efficiency, occupant comfort, and environmental sustainability while providing significant cost savings. Integrating advanced insulation materials and techniques is essential for optimizing the performance of smart buildings and achieving their full potential.

Heat transfer is a fundamental phenomenon of energy transport, generally induced by a temperature difference/gradient. The major concerns of heat transfer are temperature and heat flux management/control: heating/cooling targets to suitable temperatures and energy harvesting: converting the thermal energy from a heat source to work or other forms of energy. FIG. 1 shows the Heat Flow Diagram where heat flux flows (measured by Q) from the hot side at temperature $T_1$ to the cold side at temperature $T_2$. L is the thickness of the wall, A is area of the wall section and k (W/m·K or W/m·C) is the thermal conductivity of the material.

Today, controlling heat is becoming unprecedentedly important and challenging to meet the critical problems of global warming, energy crisis, and the heating of electronic devices, which require advanced tools to manipulate heat transfer in various forms at different length scales.

Conventional materials often have uniform and isotropic thermal conductivities in the range of ~0.03 (air, expanded polystyrene) to ~400 W/m·K (copper, silver). The thermal conductivity of fiberglass insulation, a common insulation material, is about 0.044 W/m·K.

While today the simple theories of heat transfer have been replaced by a more modern understanding of heat as disordered energy, the control of its flux is of no less importance. The significance of controlling heat flow is, however, matched by its difficulty. While, for simple tasks, like increasing the insulation of an object, the material requirements are well understood, guiding heat flux in other scenarios is more difficult.

Accordingly, there is a need for a passive thermal insulation material with enhanced thermal performance.

SUMMARY OF DISCLOSED TECHNOLOGY

A meta-material drywall and/or insulation panel (inclusive of any elongated panel) is designed to direct heat in specific directions rather than allowing the heat to spread evenly in all directions. This effect is known as anisotropic heat dissipation, where "anisotropic" is a property of heat flux which varies depending on direction of flow. The panel includes a first flat surface and a second flat surface that is parallel to the first. Between these two outer surfaces, several internal layers are arranged which alternate between being formed of a first and second material.

Each internal layer has a curved shape (a non-zero curvature) where, as such, each layer has some degree of curve therein. Each layer is further offset from at least one other layer (which includes a majority (greater than 50%) large majority (greater than 75%; with "minority" and "large minority" being the inverse, less than 50% and less than 25%) thereof being offset, substantially offset (greater than 95%, or entirely (100% offset over at least 50% of the length of each layer)).

The offset layers have the same curvature in that the layers are shifted a fixed distance away from each other, in whole, or in the parts which are offset.

Both the first and second materials are isotropic, such that heat flux passes there-through in an identical or substantially identical manner in all directions. However, the first material is conducts heat more effectively than the second material. When heat is applied to the first outer surface of the panel, most of the heat traveling through the panel moves along the curvature (curved paths) of the internal layers. A smaller amount of heat moves in a direction that is straight through the panel, perpendicular to the outer surface. This structure guides the heat in desired directions and helps manage heat flow more effectively.

The structure, in some embodiments, includes at least four internal layers made from the first material and four internal layers made from the second material, alternatingly. The width (thickness) of the layers made from each material is chosen based on how differently the two materials conduct heat. In other words, the better one material is at conducting heat compared to the other, the more its size is adjusted to control heat movement through the panel.

The panel is built to have a similar thickness and structural strength (often referred to as pull-through resistance) as ordinary drywall.

In some embodiments, each internal layer forms a loop that connects back on itself, which is referred to as a closed circuit loop. These loops may take different shapes. In some versions, the loop is shaped like an ellipse with gentle, smooth curves. In others, the loop is more rectangular, with four regions that bend more sharply (high curvature regions).

In some embodiments, the internal layers are grouped in two sets. In the first group, the curved paths of the layers are offset and shaped similarly to each other. The second group has layers that curve in the opposite direction to those in the first group. This opposite curvature is referred to as an additive inverse curvature. When an object is placed between these two groups of layers, the curvature of each group bends away from the object. This setup helps protect or mask the object from incoming heat. The term "masked from heat flux" is defined preventing a majority (>50%), a large majority (>70%), or substantially all of the heat passing from the outer panel to the inner panel from heating the object more than 1 degree Celsius over an interval of 1 minute, 5 minutes, or an hour.

Each internal layer can also include two regions with high curvature that angle in opposite directions, separated by areas with little or no curvature. These regions help guide heat in specific ways through the panel.

The materials used in the layers can be chosen based on how well they conduct heat. The first material may have a thermal conductivity greater than 0.03 watts per meter-kelvin (W/(m·K)). The second material can have a thermal conductivity less than 0.02 W/(m·K), resisting heat flow more than the first material. As a result of this design, the overall panel can achieve a very low U-value, specifically less than 0.05. The U-value is a measure of how well a building element resists heat transfer; lower values mean better insulation.

When heat is applied to the outer surface of the panel, some of that heat is guided to travel sideways, along the flat direction of the panel, rather than straight through. This directional behavior increases with each added internal layer, further supporting the anisotropic heat dissipation effect.

In a method of making the above panel, a first and second flat surface are created to form the outer boundaries. Between these, curved internal layers with non-zero curvature are placed such that they extend towards the outer surfaces. These layers are arranged so that the materials alternate: one layer made from the first material, then the next made from the second, repeating. Both materials are isotropic. The first material has higher thermal conductivity than the second material. When the panel is heated from one side, most of the heat (>50%) or substantially all of the heat in the first material travels along the curved paths, while some of the heat may move straight through the panel, specially along the wooden studs.

During construction, each internal layer may be shaped into an elliptical closed-loop with smooth curves. Alternatively, the loops may be rectangular with four sharply curved corners.

In certain configurations, the internal layers are again divided into two sets, where the first group of layers has curves that are offset from one another but follow similar patterns, and the second group has opposite curvature. An object placed between these groups will be partially shielded from heat, because the curvature of each layer bends away from the object.

Each layer may also contain two high-curvature regions that are angled equally but in opposite directions, with flatter regions in between. In this configuration, heat is directed in two opposite directions as the heat passes from one outer panel to the other outer panel.

The present disclosed technology presents a meta material thermal insulation shield, designed to provide optimum performance of the thermal insulation from the ambient medium in to the inside media to significantly improve their performance. The meta material insulation is generally an anisotropic system includes a combination of periodic arrangement of dissimilar materials arranged in a particular pattern to control heat flow. In some embodiments, the meta material, generating a anisotropic material that gives orthotropic thermal properties, uses thermal bending, whereas in others it may contain thermal cloaking to control heat flow and create an almost constant temperature regime in the middle of the drywall panel. This patent disclosure uses meta material theories, such as thermal cloaking, bending heat flux, etc., to create a thermal shield.

In some embodiments, the system of anisotropic thermal wall/system includes a plurality of dissimilar materials spaced strategically.

A "metamaterial" is defined as "an engineered material whose unusual electromagnetic, acoustic, or mechanical properties arise primarily from its deliberately designed internal structure (its geometry and arrangement of sub-wavelength building blocks) rather than from the intrinsic chemistry of its base substances." A meta-material drywall and/or insulation panel (inclusive of any elongated panel) is designed to direct heat in specific directions rather than allowing the heat to spread evenly in all directions. This effect is known as anisotropic heat dissipation, where "anisotropic" is a property of heat flux which varies depending on direction of flow. The panel includes a first flat surface and a second flat surface that is parallel to the first. Between these two outer surfaces, several internal layers are arranged which alternate in-between and created from the first and second material.

Each internal layer has a curved shape (a non-zero curvature) where, as such, each layer has some degree of curve therein. Each layer is further offset from at least one other layer (which includes a majority (greater than 50%) thereof being offset, substantially offset (greater than 95%, or entirely (100% offset over at least 50% of the length of each layer)). The offset layers have the same curvature in that the layers are shifted a fixed distance away from each other, in whole, or in the parts which are offset.

Both the first and second materials are isotropic, such that heat flux passes there-through in an identical or substantially identical manner in all directions. However, the first material is conducts heat more effectively than the second material. When heat is applied to the first outer surface of the panel, most of the heat traveling through the panel moves along the curvature (curved paths) of the internal layers. A smaller amount of heat moves in a direction that is straight through the panel, perpendicular to the outer surface. This structure guides the heat in desired directions and helps manage heat flow more effectively.

The structure, in some embodiments, includes at least six internal layers made from the first material and four internal layers made from the second material, alternatingly. The width (thickness) of the layers made from each material is chosen based on how differently the two materials conduct heat. In other words, the better one material is at conducting heat compared to the other, the more its size is adjusted to control heat movement through the panel.

The panel is built to have a similar thickness and structural strength (often referred to as pull-through resistance) as ordinary drywall.

In some embodiments, each internal layer forms a loop that connects back on itself, which is referred to as a closed circuit loop. These loops may take different shapes. In some versions, the loop is shaped like an ellipse with gentle, smooth curves. In others, the loop is more rectangular, with four regions that bend more sharply (high curvature regions).

In some embodiments, the internal layers are grouped in two sets. In the first group, the curved paths of the layers are offset and shaped similarly to each other. The second group has layers that curve in the opposite direction to those in the first group. This opposite curvature is referred to as an additive inverse curvature. When an object is placed between these two groups of layers, the curvature of each group bends away from the object. This setup helps protect or mask the object from incoming heat. The term "masked from heat flux" is defined preventing a majority (>50%), a large majority (>70%), or substantially all of the heat passing from the outer panel to the inner panel from heating the object more than 1 degree Celsius over an interval of 1 minute, 5 minutes, or an hour.

Each internal layer can also include two regions with high curvature that angle in opposite directions, separated by areas with little or no curvature. These regions help guide heat in specific ways through the panel.

The materials used in the layers can be chosen based on how well they conduct heat. The first material may have a thermal conductivity greater than 0.03 watts per meter-kelvin (W/(m·K)). The second material can have a thermal conductivity less than 0.02 W/(m·K), resisting heat flow more than the first material. As a result of this design, the overall panel can achieve a very low U-value, specifically less than 0.05. The U-value is a measure of how well a building element resists heat transfer; lower values mean better insulation.

When heat is applied to the outer surface of the panel, some of that heat continues to travel sideways, along the flat direction of the panel, rather than straight through. This directional behavior increases with each added internal layer, further supporting the anisotropic heat dissipation effect.

In a method of making the above panel, a first and second flat surface is created to form the outer boundaries. Between these, curved internal layers with non-zero curvature are placed such that they extend towards the outer surfaces. These layers are arranged so that the materials alternate: one layer made from the first material, then the next made from the second, repeating. Both materials are isotropic. The first material has higher thermal conductivity than the second material. When the panel is heated from one side, most of the heat (>50%) or substantially all of the heat in the first material travels along the curved paths, while some of the heat in the second material moves straight through the panel.

During construction, each internal layer may be shaped into an elliptical closed-loop with smooth curves. Alternatively, the loops may be rectangular with four sharply curved corners.

In certain configurations, the internal layers are again divided into two sets, where the first group of layers has curves that are offset from one another but follow similar patterns, and the second group has opposite curvature. An object placed between these groups will be partially shielded from heat, because the curvature of each layer bends away from the object.

A meta-material drywall and/or insulation panel (inclusive of any elongated panel) is designed to direct heat in specific directions rather than allowing the heat to spread evenly in all directions. This effect is known as anisotropic heat dissipation, where "anisotropic" is a property of heat flux which varies depending on direction of flow. The panel includes a first flat surface and a second flat surface that is parallel to the first. Between these two outer surfaces, several internal layers are arranged which alternate between being formed of a first and second material.

Each internal layer has a curved shape (a non-zero curvature) where, as such, each layer has some degree of curve therein. Each layer is further offset from at least one other layer (which includes a majority (greater than 50%) thereof being offset, substantially offset (greater than 95%, or entirely (100% offset over at least 50% of the length of each layer)). The offset layers have the same curvature in that the layers are shifted a fixed distance away from each other, in whole, or in the parts which are offset.

Both the first and second materials are isotropic, such that heat flux passes there-through in an identical or substantially identical manner in all directions. However, the first material is conducts heat more effectively than the second material. When heat is applied to the first outer surface of the panel, most of the heat traveling through the panel moves along the curvature (curved paths) of the internal layers. A smaller amount of heat moves in a direction that is straight through the panel, perpendicular to the outer surface. This structure guides the heat in desired directions and helps manage heat flow more effectively.

The structure, in some embodiments, includes at least four internal layers made from the first material and four internal layers made from the second material, alternatingly. The width (thickness) of the layers made from each material is chosen based on how differently the two materials conduct heat. In other words, the better one material is at conducting heat compared to the other, the more its size is adjusted to control heat movement through the panel.

The panel is built to have a similar thickness and structural strength (often referred to as pull-through resistance) as ordinary drywall.

In some embodiments, each internal layer forms a loop that connects back on itself, which is referred to as a closed circuit loop. These loops may take different shapes. In some versions, the loop is shaped like an ellipse with gentle, smooth curves. In others, the loop is more rectangular, with four regions that bend more sharply (high curvature regions).

In some embodiments, the internal layers are grouped in two sets. In the first group, the curved paths of the layers are offset and shaped similarly to each other. The second group has layers that curve in the opposite direction to those in the first group. This opposite curvature is referred to as an additive inverse curvature. When an object is placed between these two groups of layers, the curvature of each group bends away from the object. This setup helps protect or mask the object from incoming heat. The term "masked from heat flux" is defined preventing a majority (>50%), a large majority (>70%), or substantially all of the heat passing from the outer panel to the inner panel from heating the object more than 1 degree Celsius over an interval of 1 minute, 5 minutes, or an hour.

Each internal layer can also include two regions with high curvature that angle in opposite directions, separated by areas with little or no curvature. These regions help guide heat in specific ways through the panel.

The materials used in the layers can be chosen based on how well they conduct heat. The first material may have a thermal conductivity greater than 0.03 watts per meter-kelvin (W/(m·K)). The second material can have a thermal conductivity less than 0.02 W/(m·K), resisting heat flow more than the first material. As a result of this design, the overall panel can achieve a very low U-value, specifically less than 0.05. The U-value is a measure of how well a building element resists heat transfer; lower values mean better insulation.

When heat is applied to the outer surface of the panel, some of that heat continues to travel sideways, along the flat direction of the panel, rather than straight through. This directional behavior increases with each added internal layer, further supporting the anisotropic heat dissipation effect.

In a method of making the above panel, a first and second flat surface are created to form the outer boundaries. Between these, curved internal layers with non-zero curvature are placed such that they extend towards the outer surfaces. These layers are arranged so that the materials alternate: one layer made from the first material, then the next made from the second, repeating. Both materials are isotropic. The first material has higher thermal conductivity than the second material. When the panel is heated from one side, most of the heat (>50%) or substantially all of the heat in the first material travels along the curved paths, while some of the heat in the second material moves straight through the panel.

During construction, each internal layer may be shaped into an elliptical closed-loop with smooth curves. Alternatively, the loops may be rectangular with four sharply curved corners.

In certain configurations, the internal layers are again divided into two sets, where the first group of layers has curves that are offset from one another but follow similar patterns, and the second group has opposite curvature. An object placed between these groups will be partially shielded from heat, because the curvature of each layer bends away from the object.

Each layer may also contain two high-curvature regions that are angled equally but in opposite directions, with flatter regions in between. In this configuration, heat is directed in two opposite directions as the heat passes from one outer panel to the other outer panel.

Each layer may also contain two high-curvature regions that are angled equally but in opposite directions, with flatter regions in between. In this configuration, heat is directed in two opposite directions as the heat passes from one outer panel to the other outer panel." A meta-material drywall and/or insulation panel (inclusive of any elongated panel) is designed to direct heat in specific directions rather than allowing the heat to spread evenly in all directions. This effect is known as anisotropic heat dissipation, where "anisotropic" is a property of heat flux which varies depending on direction of flow. The panel includes a first flat surface and a second flat surface that is parallel to the first. Between these two outer surfaces, several internal layers are arranged which alternate between being formed of a first and second material.

Each internal layer has a curved shape (a non-zero curvature) where, as such, each layer has some degree of curve therein. Each layer is further offset from at least one other layer (which includes a majority (greater than 50%) thereof being offset, substantially offset (greater than 95%, or entirely (100% offset over at least 50% of the length of each layer)). The offset layers have the same curvature in that the layers are shifted a fixed distance away from each other, in whole, or in the parts which are offset.

Both the first and second materials are isotropic, such that heat flux passes there-through in an identical or substantially identical manner in all directions. However, the first material is conducts heat more effectively than the second material. When heat is applied to the first outer surface of the panel, most of the heat traveling through the panel moves along the curvature (curved paths) of the internal layers. A smaller amount of heat moves in a direction that is straight through the panel, perpendicular to the outer surface. This structure guides the heat in desired directions and helps manage heat flow more effectively.

The structure, in some embodiments, includes at least four internal layers made from the first material and four internal layers made from the second material, alternatingly. The width (thickness) of the layers made from each material is chosen based on how differently the two materials conduct heat. In other words, the better one material is at conducting heat compared to the other, the more its size is adjusted to control heat movement through the panel.

The panel is built to have a similar thickness and structural strength (often referred to as pull-through resistance) as ordinary drywall.

In some embodiments, each internal layer forms a loop that connects back on itself, which is referred to as a closed circuit loop. These loops may take different shapes. In some versions, the loop is shaped like an ellipse with gentle, smooth curves. In others, the loop is more rectangular, with four regions that bend more sharply (high curvature regions).

In some embodiments, the internal layers are grouped in two sets. In the first group, the curved paths of the layers are offset and shaped similarly to each other. The second group has layers that curve in the opposite direction to those in the first group. This opposite curvature is referred to as an additive inverse curvature. When an object is placed between these two groups of layers, the curvature of each group bends away from the object. This setup helps protect or mask the object from incoming heat. The term "masked from heat flux" is defined preventing a majority (>50%), a large majority (>70%), or substantially all of the heat passing from the outer panel to the inner panel from heating the object more than 1 degree Celsius over an interval of 1 minute, 5 minutes, or an hour.

Each internal layer can also include two regions with high curvature that angle in opposite directions, separated by areas with little or no curvature. These regions help guide heat in specific ways through the panel.

The materials used in the layers can be chosen based on how well they conduct heat. The first material may have a thermal conductivity greater than 0.03 watts per meter-kelvin (W/(m·K)). The second material can have a thermal conductivity less than 0.02 W/(m·K), resisting heat flow more than the first material. As a result of this design, the overall panel can achieve a very low U-value, specifically less than 0.05. The U-value is a measure of how well a building element resists heat transfer; lower values mean better insulation.

When heat is applied to the outer surface of the panel, some of that heat continues to travel sideways, along the flat direction of the panel, rather than straight through. This directional behavior increases with each added internal layer, further supporting the anisotropic heat dissipation effect.

In a method of making the above panel, a first and second flat surface are created to form the outer boundaries. Between these, curved internal layers with non-zero curvature are placed such that they extend towards the outer surfaces. These layers are arranged so that the materials alternate: one layer made from the first material, then the next made from the second, repeating. Both materials are isotropic. The first material has higher thermal conductivity than the second material. When the panel is heated from one side, most of the heat (>50%) or substantially all of the heat in the first material travels along the curved paths, while some of the heat in the second material moves straight through the panel.

During construction, each internal layer may be shaped into an elliptical closed-loop with smooth curves. Alternatively, the loops may be rectangular with four sharply curved corners.

In certain configurations, the internal layers are again divided into two sets, where the first group of layers has curves that are offset from one another but follow similar patterns, and the second group has opposite curvature. An object placed between these groups will be partially shielded from heat, because the curvature of each layer bends away from the object.

Each layer may also contain two high-curvature regions that are angled equally but in opposite directions, with flatter regions in between. In this configuration, heat is directed in two opposite directions as the heat passes from one outer panel to the other outer panel.efers to "any material engineered to have a property that is not found in naturally occurring materials, which may be made from assemblies of multiple elements fashioned from composite materials such as metals and plastics".

Any device or step to a method described in this disclosure can comprise or consist of that which it is a part of, or the parts, which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

An objective of the disclosed technology is to create a metamaterial thermal insulation shield with enhanced thermal performance for management of heat transfer using thermal meta material principles.

The disclosed technology provides anisotropic thermal wall with distinctive thermal properties in three different directions.

A meta-material drywall and/or insulation panel (inclusive of any elongated panel) is designed to direct heat in specific directions rather than allowing the heat to spread evenly in all directions. This effect is known as anisotropic heat dissipation, where "anisotropic" is a property of heat flux, which varies depending on direction of flow. The panel includes a first flat surface and a second flat surface that is parallel to the first. Between these two outer surfaces, several internal layers are arranged which alternate between being formed of a first and second material.

Each internal layer has a curved shape (a non-zero curvature) where, as such, each layer has some degree of curve therein. Each layer is further offset from at least one other layer (which includes a majority (greater than 50%) thereof being offset, substantially offset (greater than 95%, or entirely (100% offset over at least 50% of the length of each layer)). The offset layers have the same curvature in that the layers are shifted a fixed distance away from each other, in whole, or in the parts which are offset.

Figure 1:
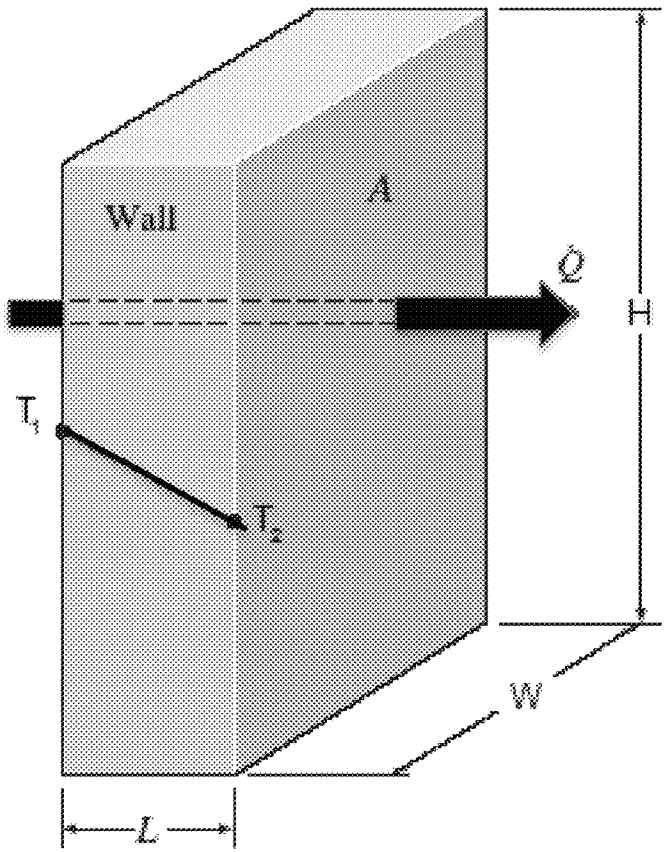
FIGURE 1 (Prior Art)
FIG. 1 shows a prior art heat flow diagram.

Engineering practice, to date, has been largely focused on materials with isotropic thermal conductivity i.e., $\kappa$ is equated to a single scalar value ($\kappa$, for example), and reported as such. In this case, the heat flux density vector (q) follows the respective temperature gradient, i.e., the heat flux in the horizontal/x-direction is only determined by the temperature gradient in that direction, as shown in FIG. 1.

It should be understood that in the prior art (see FIG. 1), heat flux through a wall is typically simplified in measurements for steady-state conditions, one-dimensional heat flow through a homogeneous material, and constant thermal conductivity, with an absence of internal heat generation. A temperature gradient is calculated primarily in one direction, and lateral heat transfer is neglected.

Figure 2:
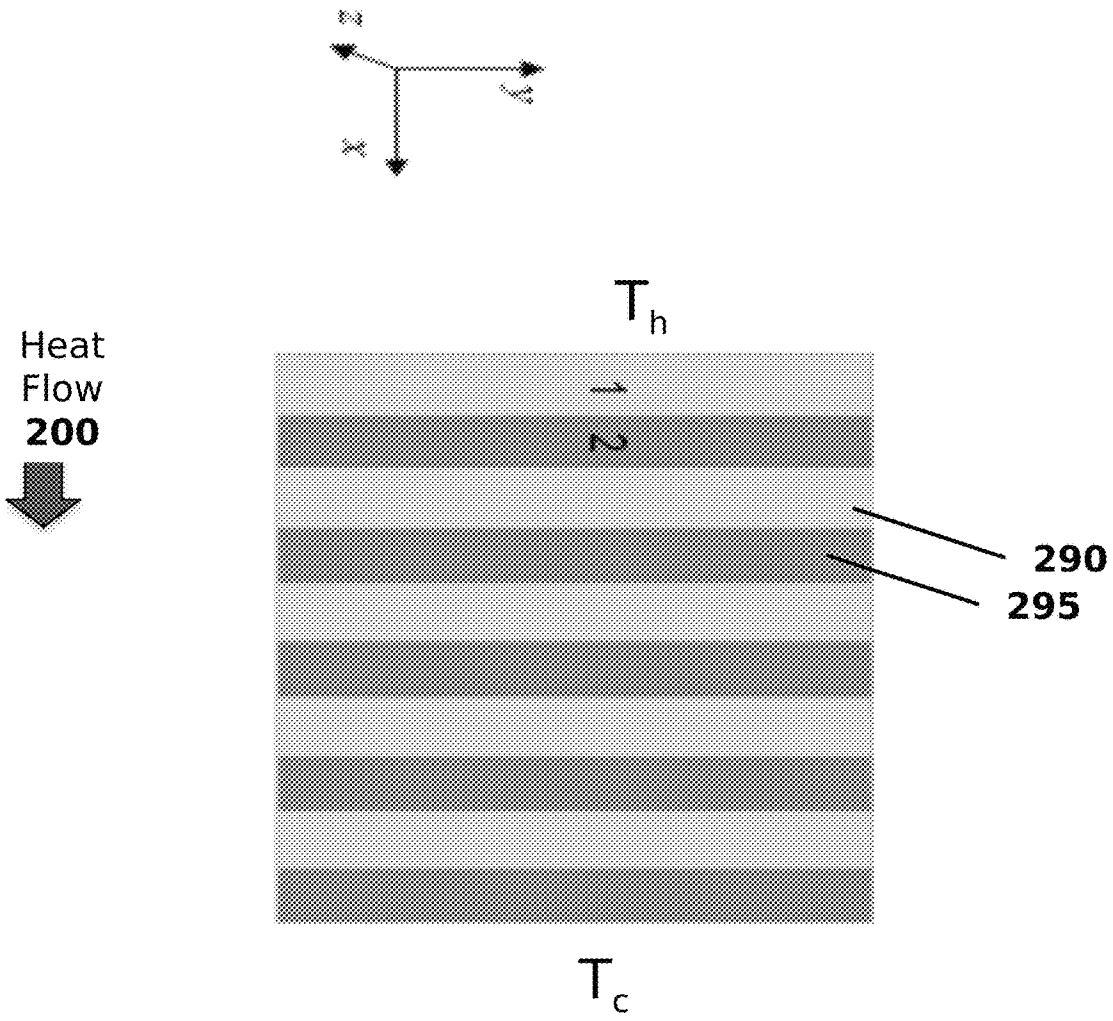
FIG. 2 shows an anisotropic thermal meta material insulation system using layers of two dissimilar, homogeneous and isotropic materials.

Turning now FIG. 2, FIG. 2 is a top, front, and side perspective view of a material as measured to determine thermal energy transference in an embodiment of the disclosed technology. Heat flux, also called thermal flux, refers to the rate of thermal energy transfer across a surface area and is typically measured in watts per square meter ($W/m^2$). Heat flux quantifies how much energy is transferred through a given surface as a result of a temperature difference. The rate of heat transfer through a material is often expressed by the equation $Q=[\kappa A(T1-T2)]/L$, where Q is the heat transfer rate in watts (W), A is the cross-sectional area in square meters ($m^2$) through which heat flows, $T_1-T_2$ is the temperature difference in kelvins (K) between the two sides of the material, and L is the thickness of the material in meters (m). Desired heat flux can be obtained in construction either by having a material with anisotropic values of the thermal conductivity, or by simply layering the materials, e.g., when two sheets with nominally isotropic thermal conductivities $\kappa_1$ and $\kappa_2$ are alternatively stacked. As materials with anisotropic heat fluxes are relatively rare, the flexibility of the disclosed technology in selecting appropriate materials and layering configurations has high applicability to many scenarios.

Meta material thermal insulation technology uses the unique properties of meta materials to control and manipulate heat transfer along multiple planes along an x, y, and z axis. If one-dimensional heat flow between two upright sides is said to proceed in the x direction, then with meta materials, in embodiments of the disclosed technology, the direction of a heat gradient is also along a y, z axes.

Naturally occurring materials generally have isotropic thermal conductivity, meaning heat flows equally in all directions. Thermal meta materials, however, are engineered to exhibit anisotropic thermal conductivity, where heat flows preferentially in certain directions. This is achieved by incorporating materials with different thermal conductivities in a specific arrangement. If a material with high thermal conductivity is aligned in one direction and low thermal conductivity in the perpendicular direction, heat will flow more easily along the high-conductivity path, effectively bending the overall heat flux.

Figure 3:
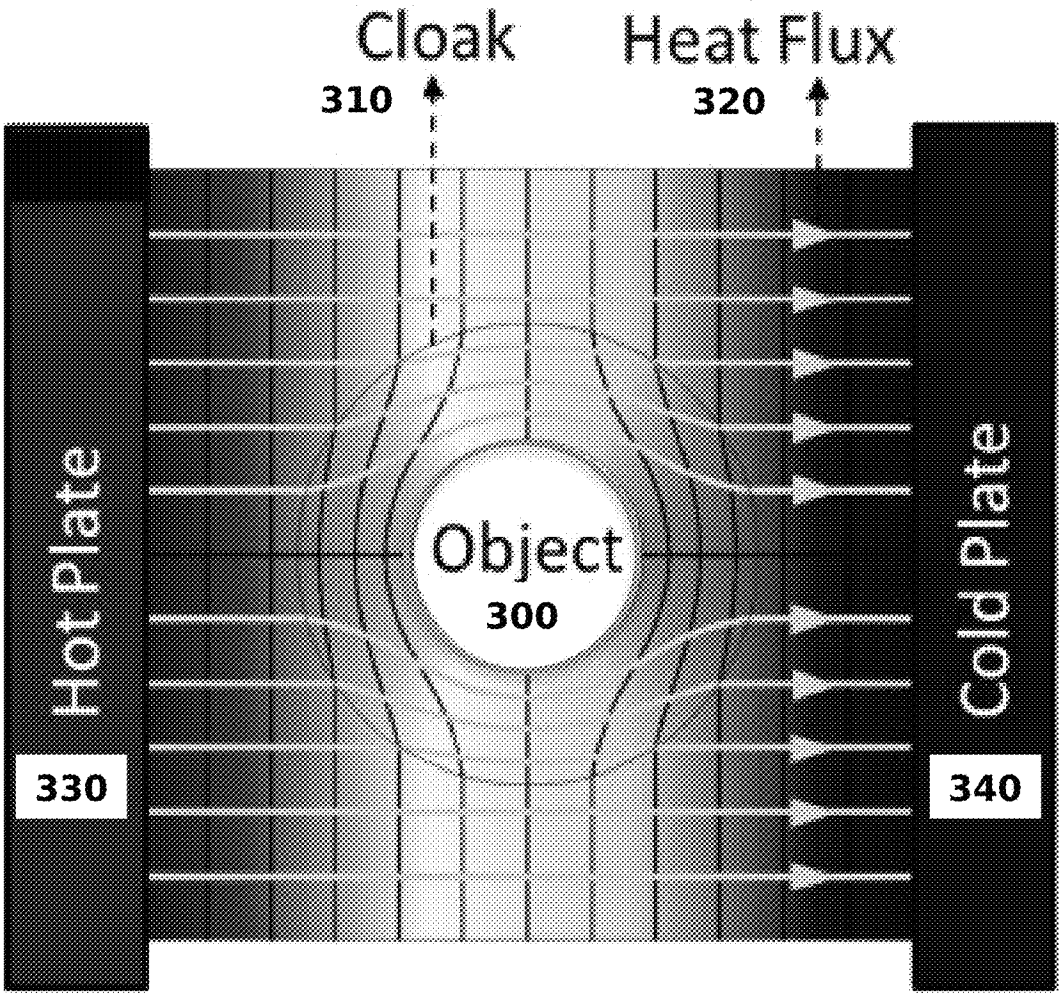
FIG. 3 shows an anisotropic thermal meta material circular cloak around an object in an embodiment of the disclosed technology.

FIG. 3 shows an anisotropic thermal meta material circular cloak around an object in an embodiment of the disclosed technology. In this feature, a "hot plate" 330, e.g. a wall/layer adjacent to a room with higher heat relative to a "cold plate" 340 which is, for example, an outer wall of a building. An object 300 is "cloaked" by having heat flux extend, for example, in the direction of the dotted arrow 310 by way of meta material pathways moving away from and around the object 300 causing heat flux 320 to move in a Y direction somewhat, compared to an isotropic pathway directly from the hot side 330 to the cold side 340.

Therefore, the heat flux is controlled through the design and arrangement of materials for the creation of elements aimed at channeling thermal energy in a desired direction, such as through rotation, bends, or other redirection. Such redirecting can be used to "cloak" an object, which is defined as, "causing a gradient of heat flow rotating away from said object until said gradient passes said object after which said heat flow is rotated in a reverse or inverse direction. Such "cloaking" can cause heat to flow "around" an object, avoiding flow through the object. A "heat gradient" and "heat flux" are used interchangeably and defined as a "direction of energy flow (from a higher to a lower energy state)" and/or "heat transfer rate per unit area".

Control or manipulation of heat flow direction within a material or a system involves heat flux rotation/bending. Methods to create artificial materials with anisotropic (direction-dependent) thermal conductivity are outlined in this patent. There are two main techniques to achieve heat flux rotation.

A first approach is to use transformation-invariant materials, which are materials that retain heat flux properties even when rotated or bent, for purposes of this disclosure. A cloaked object is cloaked by bending the heat flux around an object by varying material properties so heat travels as if the space were physically distorted along the path of the curvature of the layers of meta materials.

A second method is to use stacked/layered composites, which involves constructing a material from alternating layers of different isotropic materials thereby creating anisotropy and causing the heat flux to change direction as it propagates through the composite structure. The anisotropy needed for the bending of the heat flux is obtained either by (a) having a material with anisotropic values of the thermal conductivity, or (b) by layering materials, where the layered materials are two sheets with nominally isotropic thermal conductivities $\kappa_1$ and $\kappa_2$ which are alternatively stacked.

The advent of the transformation thermodynamics has opened the avenues to mimic the concepts of transformation optics (TO) into thermal domain. The core of transformation thermodynamics is the characteristic of governing equations to be invariant under coordinate transformation. This basic concept is applied to manipulate thermal flow, which made the thermal invisibility cloak possible. The key challenge of transformation thermodynamics is to achieve transformed material properties of being highly anisotropic and heterogeneous, which are severely different from natural materials. The concept of meta material, artificially structured to achieve desired material properties, provides the possibility to practically visualize the thermal cloak analogous to the cloaking in electromagnetic application.

On the basis of the invariance of heat conduction equation under coordinate transformations, transformation thermodynamics are used in the present technology to manipulate heat flux in desired directions, including, as discussed above, heat cloaking, which is (further) defined as, "causing temperature of a certain region to be invariant while causing a heat gradient there-around said certain region". However, in the prior art with isotropic materials, thermal cloaking, which is dependent on geometry and materials, becomes impractical.

The concept of TO has been used to realize arbitrary rotation/bending of waves within thermal meta materials that generally have anisotropic properties. Several design methodologies are proposed in order to obtain this anisotropy and to control the effective material parameters in the desired way.

Thermal flux control with meta materials is achieved using engineering materials to control how heat flows—bending, concentrating, shielding, or even inverting it in ways that natural materials simply cannot.

The mechanism of thermal cloaking involves redirecting the heat flow around the cloaked region due to transformed thermal conductivity. Thermal cloak possess two characteristics, (i) to produce zero temperature gradient region and (ii) to conceal anything placed within the cloaked region by turning the heat flow around the cloaked region.

A general equation of heat conduction without any internal heat-generation (Q=0) can be written as:

$$\nabla\cdot(K\nabla T)+\rho c\partial T/\partial t=0$$

For steady-state case, ($\partial T/\partial t=0$), Hence the simplified form of the above Eq. (1), known as the Fourier equation of heat conduction, as;

$$\nabla\cdot(K\nabla T)=0$$

Due to the form invariance characteristic of the Fourier equation of heat conduction, it keeps its form after transformation.

$$\nabla'\cdot(K'\nabla T')+\rho' c'\partial T'/\partial t=0$$

where, $$k'=J\cdot k\cdot J'/\det(J)$$

and $$\rho' c'=\rho c/\det(J)$$

Where "J" is the Jacobian transformation and "J" is the transpose of matrix "J". Cloaking is designed by linear transformation of coordinates from a circular region of radius "b" ($r\leq b$) to the annular region of the inner radius as "a". ($a\leq r\leq b$). For simplicity, a circular thermal cloak is shown in FIG. 3. The mathematical representation of cylindrical cloak and spherical cloak is as follows:

$$r'=b+r(b-a)/b,\theta'=\theta,z'=z \qquad \text{Cylindrical cloak}$$

$$r'=b+r(b-a)/b,\theta'=\theta,\phi'=\phi \qquad \text{Spherical cloak}$$

The Jacobian matrix can be calculated as;

$$J=\partial(x',y',z')/\partial(x,y,z)=\partial(x',y',z')/\partial(r',\theta',z')\cdot\partial(r',\theta',z')/\partial(r,\theta,z)\cdot\partial(r,\theta,z)/\partial(x,y,z)$$

From these equations, the anisotropic conductivity of the transformed thermal cloak is obtained as, $$\frac{k'}{k}\left\{\left(\frac{b}{b-a}\right)\cdot\mathrm{diag}\begin{bmatrix}\left[\left(b-\frac{a}{b}\right)\cdot\frac{r}{r'}\right]^2 & 0 & 0\\ 0 & 1 & 0\\ 0 & 0 & 1\end{bmatrix}\right\}$$

$$k'/k=\left(b/(b-a)\right)\cdot\mathrm{diag}\left[\left(\left(b-a/b\right)\cdot r/r'\right)^2 11\right]$$

The governing equation of convection heat transfer, $Q_{conv}$, is as follows, $$Q_{conv}=hA(T_w-T_\infty)$$

where, h=convection heat transfer coefficient, A=effective surface area, $T_w$=fin wall temperature, and $T_\infty$=environment temperature/room temperature.

Thermal meta materials used herein are designed to manipulate heat flux, effectively acting as "thermal cloaks" that can guide or redirect heat around a specific area. These meta materials utilize structures with tailored thermal properties to control heat transfer. A circular thermal cloak can be designed with inhomogeneous and anisotropic conductivities expressed as $\kappa_r=\kappa_b(r-a)/r$ and $\kappa_\theta=\kappa b_r/(r-a)$, where $\kappa_b$ is the thermal conductivity of background.

Analogously, an elliptical thermal cloak is used herein in elliptical coordinate system ($\xi$, $\eta$) based on TO method, as demonstrated in FIG. 3. The material parameters are also inhomogeneous, anisotropic, and singular ($\kappa_\xi$ becomes infinity when $\xi\rightarrow 1$). To avoid singularity, the parameters have to be simplified, which leads to a constant $\kappa_\eta$ and varied $\kappa_\xi$. Note that $\alpha=(\xi-\xi_1)(\xi_2-1)/(\xi_2-\xi_1)+1$. For practical realization, such a cloak can be approximated with alternating large and small thermal conductivities.

Figure 4:
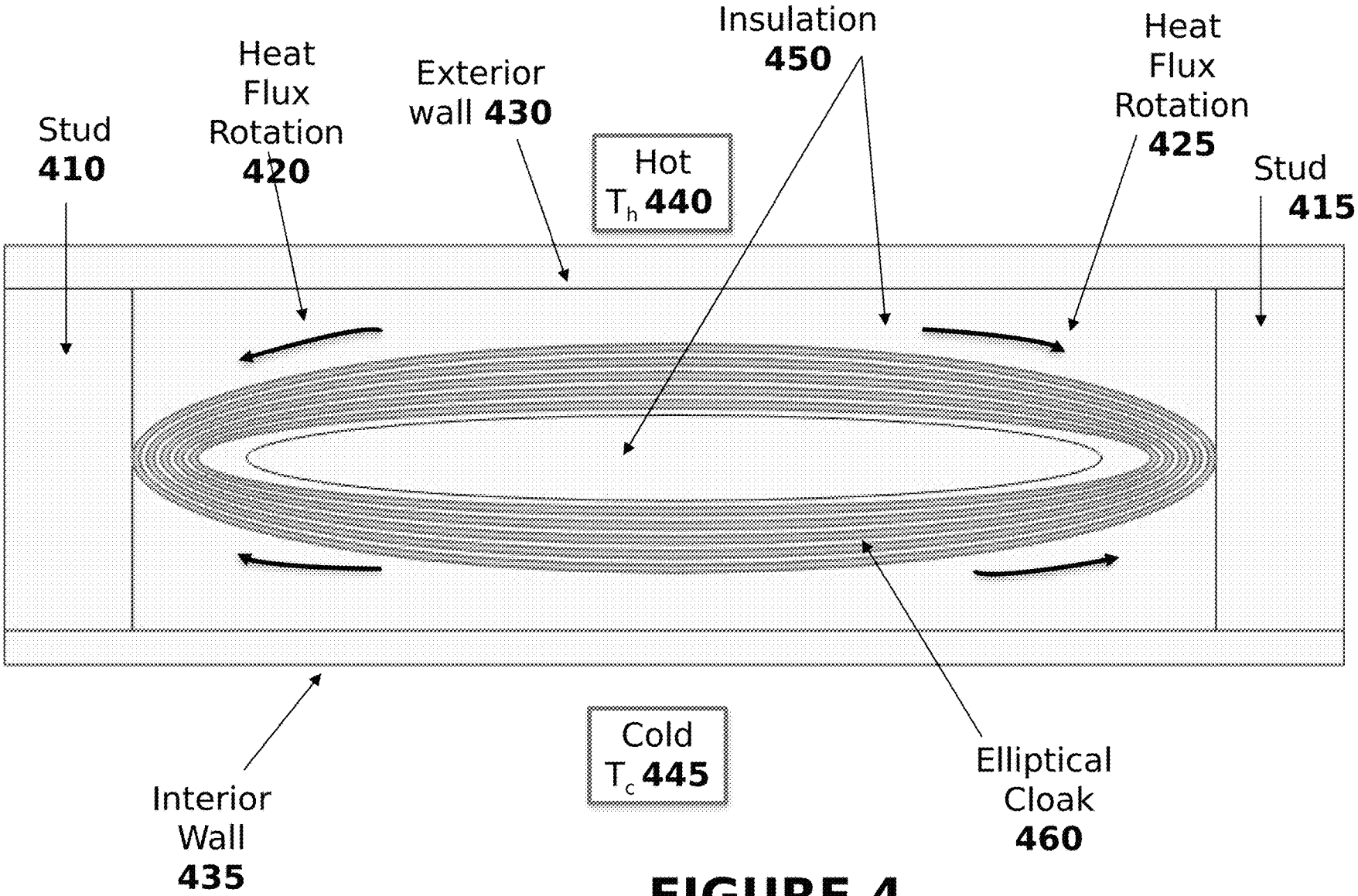
FIG. 4 shows an anisotropic thermal meta material insulation system using an elliptical cloak in an embodiment of the disclosed technology.
Figure 5:
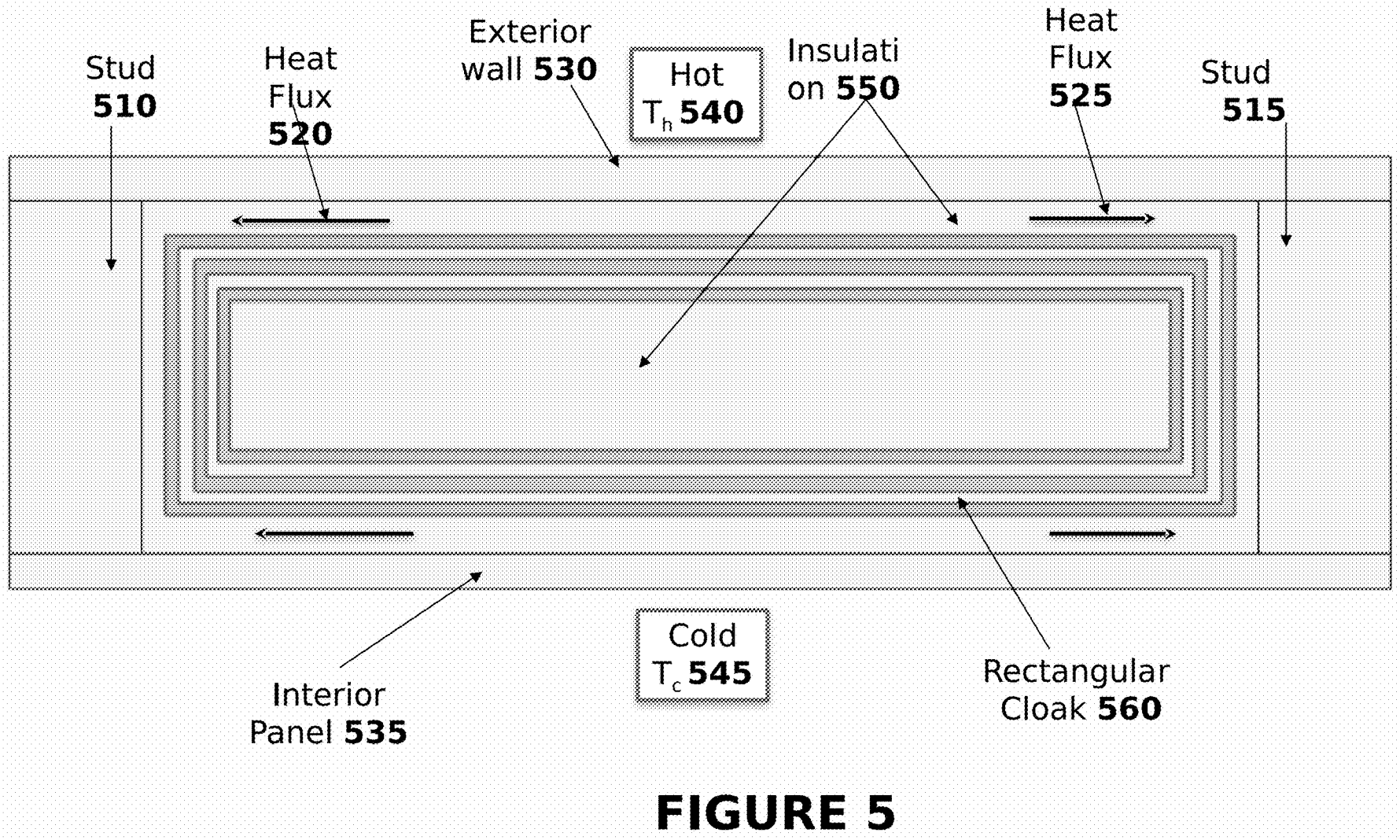
FIG. 5 shows an anisotropic thermal meta material insulation system using a rectangular cloak.

Using the thermal meta materials based on transformation theory, a practical strategy can be formulated for controlling heat flow by engineering spatial distributions of material parameters, implementing interesting functions such as cloaking, concentrating, and rotating. A thermal cloak redirects heat flow around a specific region, making it appear as if the heat source is not present or affecting the surrounding area. Thermal cloaks may be designed using alternate layering of two materials in a spherical or cylindrical topography and guided by the cloaking approach defined above. For example, elliptical and rectangular cloaks, for inclusion in a drywall, are shown in FIGS. 4 and 5 and discussed hereinbelow.

The symmetry of the Maxwell equations for electromagnetic waves is not apparent in the Fourier law of heat conduction, where heat transport is diffusive with the flux in the $i^{th}$ direction ($q_i$):

$$q_i = -\kappa_{ij} \nabla T_j$$

Where $\kappa_{ij}$ represent the components of the second order thermal conductivity tensor, with respect to a rectangular (x-y-z) coordinate system, i.e., $$\kappa_{ij} = \begin{pmatrix} \kappa_{xx} & \kappa_{xy} & \kappa_{xz} \\ \kappa_{yz} & \kappa_{yy} & \kappa_{yz} \\ \kappa_{zx} & \kappa_{zy} & \kappa_{zz} \end{pmatrix}$$

With $\nabla T_j$ being the temperature gradient in the $j^{th}$ direction with (i=j), for materials with isotropic thermal conductivity).

A thermal conductivity tensor plays a crucial role in inducing and controlling heat flux rotation in materials by describing their anisotropic thermal conductivity. The mechanism in heat flux rotation is as follows: (1) Anisotropic Thermal Conductivity: In materials with anisotropic thermal conductivity, the ability to conduct heat varies depending on the direction. The thermal conductivity tensor mathematically represents this directional dependence, with different values along different axes. (2) Off-Diagonal Components: The orientation of layers within a material, especially in composite materials, can introduce off-diagonal components in the thermal conductivity tensor, inducing anisotropy. (3) Bending Heat Flux: The off-diagonal components of the tensor can cause heat flux lines to bend or rotate, changing the direction of heat flow. This phenomenon is dependent on factors like the material's composition and the angle of the layers.

FIG. 4 shows an anisotropic thermal meta material insulation system using an elliptical cloak in an embodiment of the disclosed technology.

Discussing FIG. 4 first, in this top plan view (looking downwards) on a wall with an interior side 435 and exterior side 430, there are two spaces, one of which is a cold space 445 opposite a hot space 440. These "spaces" are ambient air on the side of a wall or layer of wall between an exterior wall 430 and interior wall 435. (The "exterior" and "interior" can be used in reverse). A stud 410 and 415, shown at either end by way of example. By placement of the layers of isotropic materials, an elliptical cloak 460 causes heat to passing through the insulated wall 450 to "rotate" or move along the xz axis (where y is vertical, and z is a direction from the exterior wall 430 to the interior wall 435). The "rotation" is in two opposite directions simultaneously in this example (e.g. −x, +z; +x, +z axis) and an area between the meta material layers (insulation 450) remains "cloaked" as defined above.

By manipulating the material's orientation and layering, the degree and direction of heat flux rotation can be controlled. The controlled transmission of heat is hard to achieve in one (isotropic) material or device because heat is carried by a broad spectrum of high-frequency (terahertz) phonons that are extremely difficult to control. Moreover, micro scale heat transport in solids is diffusive based on the Fourier's law of heat conduction: $q_i = -\kappa_{ij} \nabla T_j$, where $\kappa_{ij}$ represents the second-order thermal-conductivity tensor. Here, $q_i$ and $\nabla T_j$ are the heat flux and temperature gradient in the $i^{th}$ and $j^{th}$ directions, respectively. The path of heat conduction, thus, can be controlled by engineering an artificial material with prescribed anisotropy in its thermal-conductivity tensor.

FIG. 5 shows an anisotropic thermal meta material insulation system using a rectangular cloak. Elements of FIG. 4 which are congruent/closely related have been incremented by 100 in FIG. 5. Here, heat from the hot area 540 flows by way of a heat gradient/heat flux towards the cold 545 through the shown wall having an exterior side 530 and interior side 535. Insulated area 550 lower heat passage there-through while the heat is corralled into the meta materials shown as the "rectangular cloak" 560. Due to the lower heat capacity of the cloak, relative to the insulation 550, the heat follows the path of the cloak, such that only a small minority of the heat passes through the insulated region while the large majority of the heat passes through the cloak in the direction of heat flow 520 and 525.

Figure 6:
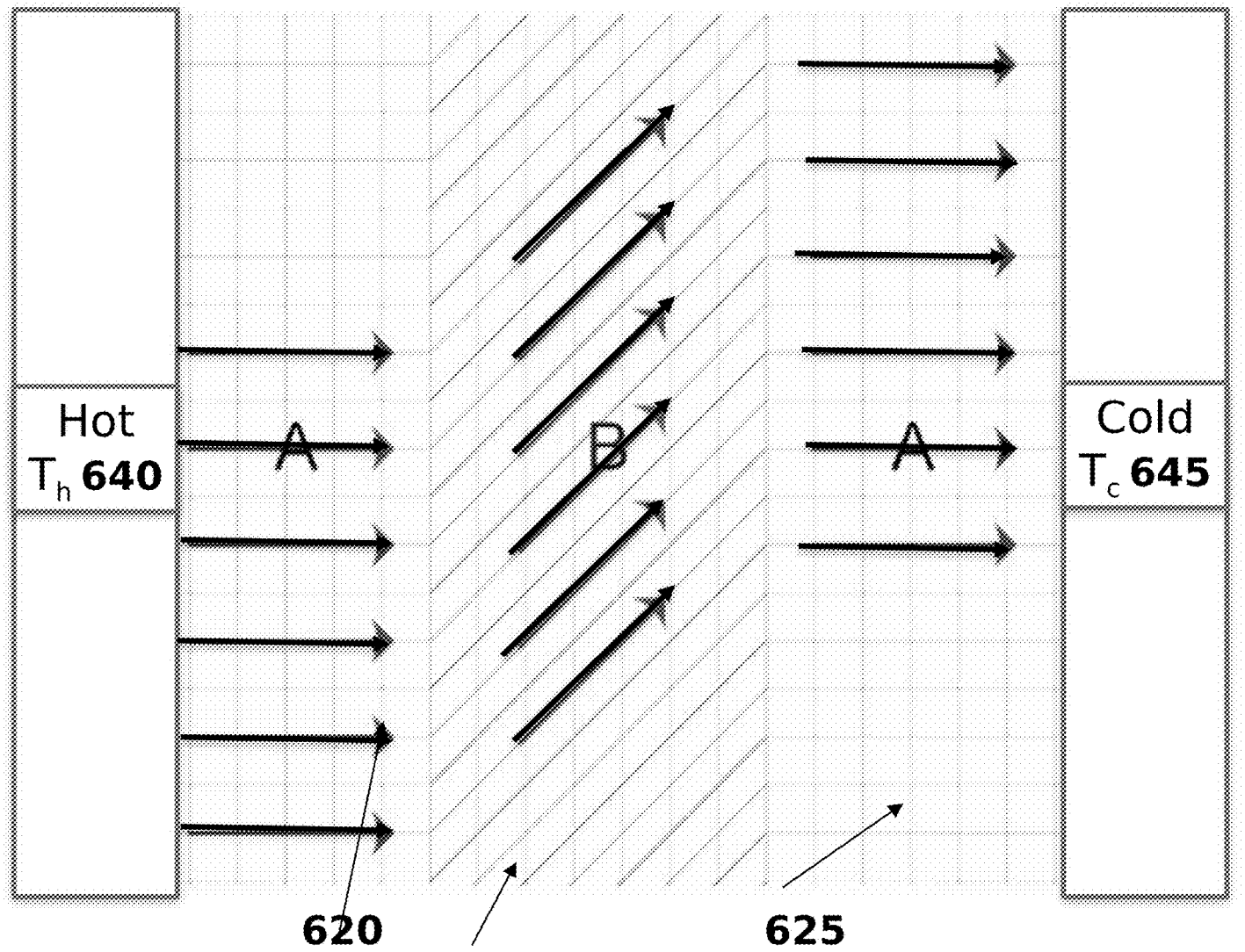
FIG. 6 shows an anisotropic thermal meta material heat flux rotator system using layers of two dissimilar, homogeneous and isotropic materials in an embodiment of the disclosed technology.

FIG. 6 shows an anisotropic thermal meta material heat flux rotator system using layers of two dissimilar, homogeneous and isotropic materials in an embodiment of the disclosed technology. In some embodiments, FIG. 6 is an inset or magnified version of a part of FIGS. 4 and 5. Elements of FIG. 6, where analogous with FIGS. 4 and 5, have been incremented by 200 and 100, respectively, relative to the prior figures.

Here, if using isotropic substances, heat would substantially flow through the wall from the interior side to exterior side in a direction from 640 to 645 (hot to cold; along the z-axis). The rotated meta materials are placed in section B, between the two A sections. The A sections are isotropic material, and as such, the heat flux is substantially all along the Z-axis in these locations within the wall. However, at B, anisotropic meta materials have layers aligned diagonally, relative to the inner and outer wall direction of longest extent. That is, the meta materials have layers that extend in a direction of the +z and +x axis. Therefore, the heat flux 620 and heat flux 625 extend along the z axis while the heat flux 630 extends along the x and z axis, in this embodiment, in equal amounts. Viewing FIG. 6 juxtaposed with FIG. 4, where FIG. 6 can be seen as a quasi-detailed inset side elevation view of FIG. 4, the heat flow is twisted or turned while passing through the wall.

Figure 7:
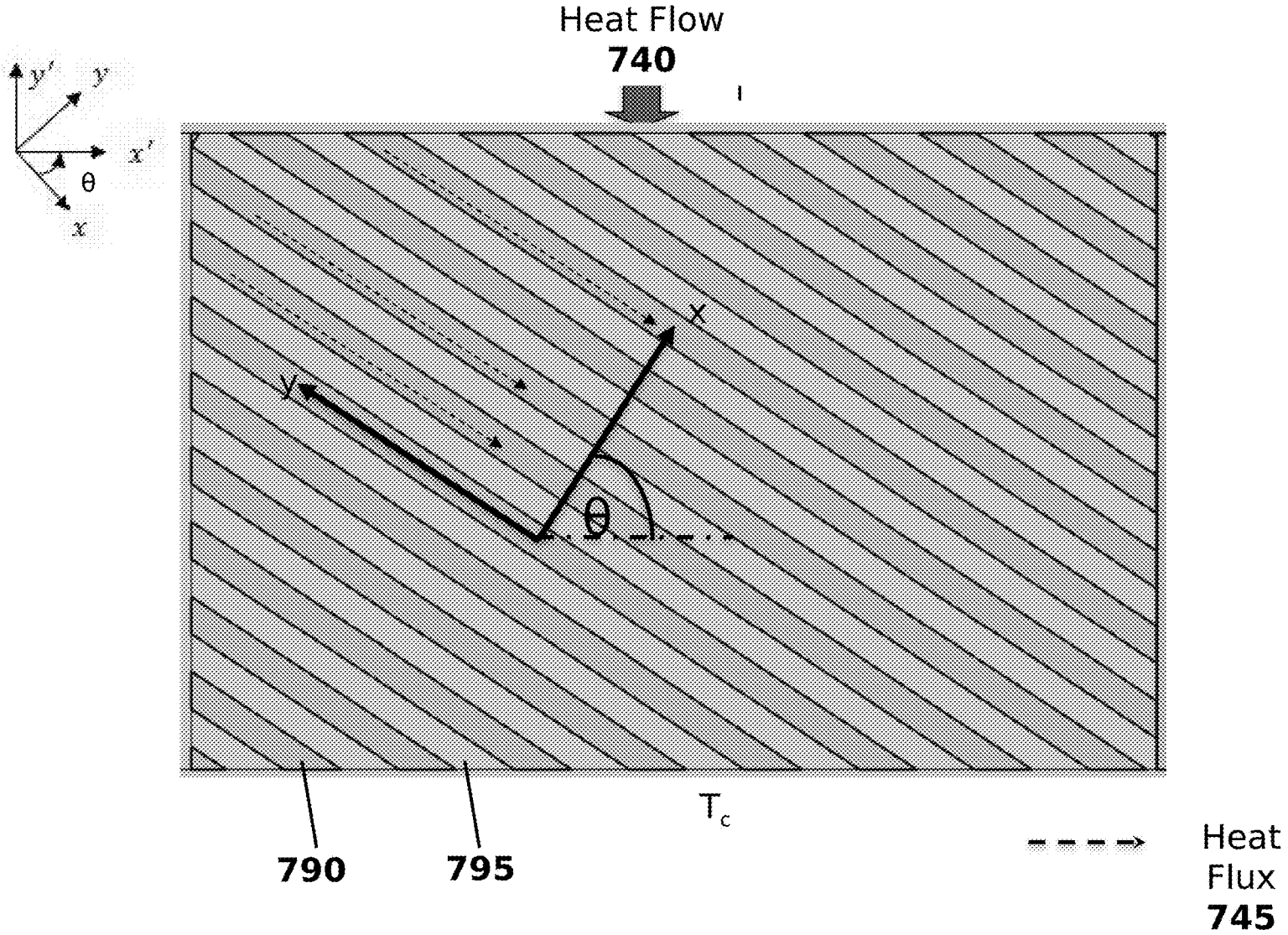
FIG. 7 shows an anisotropic thermal meta material for heat flux rotation.

FIG. 7 shows an anisotropic thermal meta material insulation shield using a thermal flux rotation system comprising of rotated stacked layers, made of two isotropic layers 790 and 795. The rotation of stacked layers by θ degree, also redirects the heat flux along the dotted lines shown in FIG. 7. Although heat flux is applied normally at the outer layer (hot side) 740, the heat flux is rotated by θ degrees along the lines of rotation on the way to the cold side, instead of going through normally as would have happened in an isotropic layer.

Figure 8:
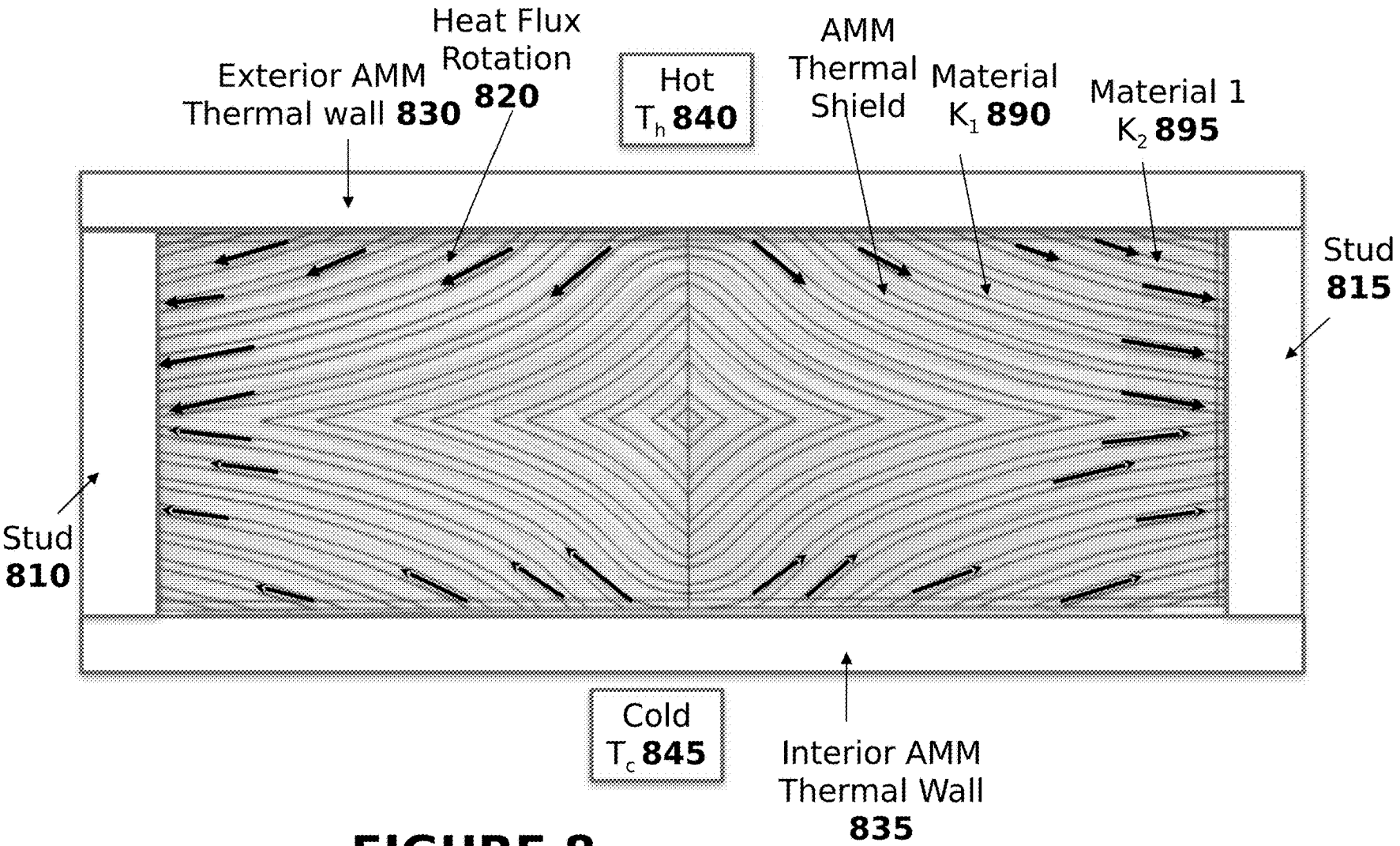
FIG. 8 shows an anisotropic thermal meta material insulation system comprising of heat flux rotator/bender and elliptic cloak system containing layers of two dissimilar, isotropic materials.

FIG. 8 shows an anisotropic thermal meta material heat flux rotator/bender and cloaking system comprising layers of two dissimilar, isotropic materials. Again, elements of the prior figures have been incremented by a multiple of 100 compared to prior figures. A hot side area 840 (such as a room with electronic equipment) and a cold side 845 (such as outside of a building) have wood studs 810 and 815, or any other support structure between the wall which extends between the hot and cold sides 840 and 845. There can be multiple spaced apart studs, and as such, FIG. 8 represents only a small portion of a wall, in this top down view. Layers of isotropic material, as described above, form an anisotropic layer at the outside of each wall, specifically, a thermal wall 830 abutted against the hot area 840 and a thermal wall 835 abutted against the cold area 845. The "walls" may also include coverings (non-meta material layers) and/or meta material layers. Between these exterior and interior thermal walls 830 and 835 are layers of anisotropic meta materials, alternating between two layers 890 and 895 having different thermal conductivity, with one layer significantly higher (>20% or >50%) thermal conductivity than the other. For example, one material has a thermal conductivity of greater than 0.03 W/(m*K) and the other has a thermal conductivity of less than 0.02 W/(m*K).

A more detailed explanation of the principles underlying the technology disclosed herein, follows.

Traditional (Prior Art) engineering practice, to date, has been mostly focused on materials with isotropic thermal conductivity, i.e., $\kappa_{ij}$ is equated to a single scalar value ($\kappa$, say), and reported as such. In this case, the heat flux density vector ($q_i$) follows the respective temperature gradient, i.e., the heat flux in the horizontal/x-direction is only determined by the temperature gradient in that direction. The presence of off-diagonal terms, i.e., ij $\kappa$ with $i \neq j$, would induce cross-coupling and related bending of the heat flux, e.g., with a substantial $\kappa_{xy}$, the heat flux in the x-direction would be determined by the temperature gradient in both the x- and an orthogonal/y-/z-direction. Such considerations aimed toward the controlled bending/manipulation of the thermal flux lead to the design of materials with anisotropic thermal conductivity, where the off-diagonal components of $\kappa_{ij}$ are crucial.

Anisotropic materials, unlike isotropic materials, have thermal conductivity that varies depending on the direction of heat flow. This direction-dependent property can lead to situations where the heat flux, or the rate of heat flow per unit area, is not aligned with the temperature gradient, resulting in a rotational effect on the heat flux When the thermal conductivity tensor has off-diagonal components (e.g., $k_{xy}$, $k_{yx}$) it implies that a temperature gradient along one axis can induce heat flow in a different, non-parallel direction. This also means the heat flux vector q is not necessarily parallel to the temperature gradient vector $\nabla T$.

For a material with a temperature gradient applied in a particular direction, Ii the material is anisotropic, the internal structure dictates that heat might preferentially flow along different paths than directly along the gradient. This preferential heat flow can lead to a bending or rotation of the heat flux lines as they propagate through the material, as shown in FIGS. 3-8.

The presence of off-diagonal elements in the conductivity tensor is the key for how heat flux can be rotated or steered, as it allows a temperature gradient in one direction to induce heat flow in a different direction. This phenomenon has practical implications for applications like thermal management and heat flux control.

Using the meta material design process, the structure and properties, heat flow can be redirected or rotated. It involves using alternating layers of materials with different thermal conductivities and arranging them at specific angles. Rotating these layers introduces off-diagonal components in the thermal conductivity tensor, leading to a bending or rotation of the heat flux. The heat flux can be rotated by 45 degrees or −45 degrees using such layered meta materials.

An illustration of an anisotropic material of total length, 1, which may be fabricated by alternatively stacking two thin sheets (of individual thickness: 1/n)—1 and 2—of thermal conductivities $\kappa_1$ and $\kappa_2$ is shown in FIG. 2. The top side is maintained at a uniform temperature: $T_h$, while the bottom side is at a lower uniform temperature, $T_c(<T_h)$. The case of $\kappa_1/\kappa_2=1$ corresponds to a homogeneous material.

For a one-dimensional parallel and perpendicular $$\kappa_{ij} = \begin{pmatrix} \kappa_x & 0 & 0 \\ 0 & \kappa_y & 0 \\ 0 & 0 & \kappa_z \end{pmatrix} = \begin{pmatrix} \frac{2\kappa_1\kappa_2}{\kappa_1+\kappa_2} & 0 & 0 \\ 0 & \frac{\kappa_1+\kappa_2}{2} & 0 \\ 0 & 0 & \frac{\kappa_1+\kappa_2}{2} \end{pmatrix}$$

heat transport, between the surface on the right (maintained at a temperature: $T_h$) and the left surface (at a lower temperature: $T_c$), assuming flux continuity and neglecting interfacial effects, thermal conductivity tensor is given by:

Generally, $\kappa_{ij}$—a second order thermal conductivity tensor with respect to an orthogonal (x-y-z) coordinate system—is represented through, e.g., $$\kappa_{ij} = \begin{pmatrix} \kappa_{xx} & \kappa_{xy} & \kappa_{xz} \\ \kappa_{yz} & \kappa_{yy} & \kappa_{yz} \\ \kappa_{zx} & \kappa_{zy} & \kappa_{zz} \end{pmatrix}$$

The longitudinal thermal conductivity ($\kappa_x=2\kappa_1\kappa_2/(\kappa_1+\kappa_2)$) is always less than or equal to the transverse thermal conductivity, ($\kappa_y=(\kappa_1+\kappa_2)/2$), as the harmonic mean is less than or equal to the arithmetic mean. In such a formulation, it is assumed that the layer thickness is sufficiently small, which is equivalent to the principle that a linear temperature gradient can be defined.

If the orientation of the layers in the thermal composite is rotated, in the plane, say, by an angle $\theta$ ($-\pi/2<\theta<\pi/2$, with $\theta$ considered positive in the counter-clockwise direction—FIG. 6-7), the layers are now oriented along new axes: x' (=x cos $\theta$+y sin $\theta$) and y' (=−x sin $\theta$+y cos $\theta$). The originally applied (horizontal) temperature gradient now acquires both horizontal and vertical components, with respect to the rotated layers.

Considering that the heat conduction equation, can be written as $\nabla \ldots (\kappa_{ij} \nabla_j)=0$, it can be shown that in a changed coordinate system, the modified thermal conductivity ($\kappa^m{}_{ij}$) would be $$\kappa^m{}_{ij}=J\kappa_{ij}J^T/\det(J)$$

where J is the Jacobian matrix of the coordinate transformation between the new and the old coordinate systems, $J^T$ is the transpose of J and det(J) denotes the determinant. Consequently, with the introduction of off-diagonal components into $\kappa_{ij}$ through the layer rotation, the thermal conductivity is modified to:

$$\kappa_{ij}''' = \frac{J\kappa_{ij}J^T}{\det(J)} = \begin{pmatrix} \kappa_x\cos^2\theta + \kappa_y\sin^2\theta & (-\kappa_x + \kappa_y)\sin\theta\cos\theta & 0 \\ (-\kappa_x + \kappa_y)\sin\theta\cos\theta & \kappa_y\cos^2\theta \div \kappa_x\sin^2\theta & 0 \\ 0 & 0 & \kappa_z \end{pmatrix}$$

For a change in the heat flux density vector, a unidirectional temperature gradient (along the line x',—see FIG. 7 for changed axes orientation) is applied to the composite with $\kappa_{ij}^{m}$, then heat flux density is given by:

$$q_i''' = -[\kappa_x\cos^2\theta + \kappa_y\sin^2\theta]\frac{dT}{dx'}\hat{x}' - [(-\kappa_x + \kappa_y)\sin\theta\cos\theta]\frac{dT}{dy'}\hat{y}'$$

The heat flux density ($q_i$), thus, acquires a transverse component, i.e., in the y' direction, for $\theta_2 \neq p\pi/2$ where p is an integer. The extent of heat flux bending, as deduced through the deviation ($\varphi$) of $q_i$ would then be:

$$\phi = \tan^{-1}\left[\frac{(-k_x + k_y)\sin\theta\cos\theta}{k_x\cos^2(\theta) + k_y\sin^2(\theta)}\right] = \tan^{-1}\left[\frac{(1 - k_e)\sin\theta\cos\theta}{\cos^2(\theta) + k_e\sin^2(\theta)}\right]$$

Where $$\kappa_e = k_y/k_x = \frac{1 + \frac{k_1}{k_2}}{4\frac{k_1}{k_2}}$$

In the transformed coordinates the modified Fourier law may be written as:

$$q_i''' = -\kappa_{\eta}'''\nabla T_j'''$$

Thermal meta material structures can now be designed to control and guide heat flux along the desired direction/path by transformation thermodynamics. Fundamentally, tensors are general objects for expressing transformed coordinates since their mathematical notation can independently describe any kind of coordination system, regardless of its original coordinates. The heat conduction equations are applicable regardless of the specific coordinate system, as well.

Meta material thermal rotator/benders composed of layered system of two isotropic materials can be used to rotate heat flux on demand with good manufacturability. Considering two alternatively stacked isotropic materials with thermal conductivities of $k_1$ and $k_2$ as shown in FIG. 7. The heat flux rotation is a function of the composite layer orientation. Assuming material 1 is Cu ($k_1$=390 W/mK) and material 2 is stainless steel ($k_2$=42 W/mK), the heat flux can be rotated/bended upward by 26° when composite layer orientation $\theta$=45°. A large thermal-conductivity (between $k_1$ and $k_2$)) ratio leads to a large heat flux rotation.

In the context of thermal meta materials, a detailed design of artificial structures or materials can be used to manipulate heat flow in unconventional manners. This would involve tailoring the thermal conductivity tensor in anisotropic or inhomogeneous ways to achieve desired functionalities, such as thermal cloaking, heat guiding, or diffusion.

The ability to control thermal energy through mediums has significant implications. The controlled transmission of heat is hard to achieve in one (isotropic) material or device because heat is carried by a broad spectrum of high-frequency (terahertz) phonons that are hard to control. Moreover, micro scale heat transport in solids is diffusive based on the Fourier's law of heat conduction: $q_i = -\kappa_{ij}\nabla T_j$, where $\kappa_{ij}$ represents the second-order thermal-conductivity tensor. Here, $q_i$ and $\nabla T_j$ are the heat flux and temperature gradient in the i-th and j-th directions, respectively. The path of heat flux conduction can be controlled by engineering an artificial material with prescribed anisotropy in its thermal-conductivity tensor.

Although the primary function of a meta material thermal cloak and a thermal rotator is to redirect heat flow, it can be designed to reduce thermal conductivity. By strategically arranging materials with different thermal conductivities within the meta material, a high degree of anisotropy can be achieved in the material's effective thermal properties, enabling precise control over heat flow.

The technical approach, presented in this patent, to create anisotropic thermal conductivity patterns in insulation shield uses both thermal cloak principle and the anisotropic, rotated system/stacks of alternate layers of isotropic materials. By adjusting the thickness, arrangement, rotation and materials of these layers, and arranging them in an exclusive cloak, heat flux can be controlled and guided through the insulation. Such a distinctive meta material thermal shield, with heat flux rotation, is shown in FIG. 8. A desired anisotropic effective thermal conductivity, thus, can be achieved.

Referring again to FIG. 8, heat flux is guided along the curved lines of the meta material insulation layers towards left and right sides. The majority of heat flux, therefore, does not go through straight the insulation system, as would be the case for an isotropic insulation. Such an arrangement of a thermal cloak can significantly reduce the temperature gradient in the central area. Thus, the process of thermal cloaking with heat flux rotation would result in decrease in thermal conductivity of the meta material insulation. The heat flux, which is diverted along both sides, can be pumped upwards by forced convection using fans.

The main objective of the meta material cloak with heat flux rotation is to divert the heat flux path to reduce thermal conductivity of the insulation package. Several meta material thermal cloaks with heat flux rotation can be designed to achieve the diversion of heat flux to reduce U-value or increase R-value of the insulation package.

The portals of embodiments of the disclosed technology to control/guide of propagation of thermal energy all the way through walls resulting an improved thermal shield, while at the same time, For purposes of this disclosure, "isotropic" is defined as "having a physical property equal in three dimensions". A material isotropic in thermal conductivity conducts heat equally (per unit volume of material traversed) regardless of which side heat is applied. An "anisotropic" material, inversely, has different physical properties depending on directionality. Thus, an "anisotropic effect" regarding heating conductivity is a condition wherein heat is conducted in a first direction with greater facility than the same heat being conducted in a different direction through a given material. Anisotropic thermal conductivity is thus highly useful for thermal regulation, insulation, heating, and cooling. A "meta material" is defined as "an artificial composite material engineered to have a specific physical property," such as anisotropic conductivity. Some anisotropic materials may be "orthotropic", meaning that the magnitude of physical properties vary between three mutually perpendicular axes.

For purposes of this disclosure, the term "substantially" is defined as "at least 95% of and up to and including 100% of" the term which it modifies.

Any device or aspect of the technology can "comprise" or "consist of" the item it modifies, whether explicitly written as such or otherwise.

Any device or step to a method described in this disclosure can comprise or consist of that which it is a part of, or the parts that make up the device or step. The term "and/or" is inclusive of the items which it joins linguistically and each item by itself.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described herein above are also contemplated and within the scope of the invention.

The offset curves with non-zero curvature" are defined as, "a non-straight line". The layers described herein are hollow or filled with various materials, alternating, as described herein-above.

In other embodiments of the disclosed technology, instead of "offset curves with non-zero curvature", curves that can be used (if claimed as such) are parallel curves, offset curves, concentric bends, parallel routing, and non-linear offset curves. Tubes that curve in exactly the same manner but are offset from each other (maintaining constant distance between them) are "parallel curves" or "offset curves" which can describe any two or more adjacent layers in embodiments of the disclosed technology. Further, parallel curves are curves that maintain a constant perpendicular distance from each other at every point.

A "loop" or "closed loop" used in embodiments of the disclosed technology refers to a layer, which is a curve that bends around and crosses itself. Such a loop can be a circular/elliptical loop, rectangular loop (with acute curves), or a closed curve loop.

The term, "additive inverse" or "opposite" is defined as a number when added to the original number equals zero. The example, the additive inverse of 10 is −10 because these numbers add to zero.

Curves in a part of a layer of material can be zero, non-zero, low curvature, acute bend, or sharp turn (high curvature). In embodiments of the disclosed technology, each layer of material has at least a portion thereof with a non-zero curvature. For purposes of this disclosure, a low curvature is from 0.01 to 30 degrees; acute bend is between 30 degrees and 60 degrees; acute bend (high curvature) is between 60 and 90 degrees, inclusive.

For purposes of this disclosure, the term "substantially" is defined as "at least 95% of" the term which it modifies.

Any device or aspect of the technology can "comprise" or "consist of" the item it modifies, whether explicitly written as such or otherwise.

Any device or step to a method described in this disclosure can comprise or consist of that which it is a part of, or the parts which make up the device or step. The term "and/or" is inclusive of the items which it joins linguistically and each item by itself.

When the term "or" is used, it creates a group which has within either term being connected by the conjunction as well as both terms being connected by the conjunction.

While the disclosed technology has been presented with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described herein above are also contemplated and within the scope of the invention.

What is claimed is:

1. A meta-material drywall and/or insulation building panel with an anisotropic heat dissipating effect, comprising a first planar side, a second planar side parallel to said first planar side, a plurality of inner layers disposed between and parallel to said first planar side and said second planar side;

said plurality of inner layers of said building panel alternates between an inner layer formed from a first material and an inner layer formed from a second material, each said inner layer of said plurality of inner layers formed, at least partially, as an offset curves with non-zero curvature of at least one other inner layer of said plurality of inner layers, and each of said first material and said second material are isotropic;

said first material has a thermal conductivity greater than a thermal conductivity of said second material;

wherein, upon said first planar side being heated:

a majority of heat traversing each said inner layer disperses along a curvature of said plurality of inner layers; and a portion of heat traversing each said inner layer disperses along a plane perpendicular to said first planar side.

2. The meta-material drywall and/or insulation building panel of claim 1, wherein said plurality of inner layers comprises at least four layers of said first material and four layers of said second material.

3. The meta-material drywall and/or insulation building panel of claim 2, wherein an increase in heat flux rotation is caused by an increase in a thermal conductivity ratio between said thermal conductivity of said first material and said thermal conductivity of said second material.

4. The meta-material drywall and/or insulation building panel of claim 1, wherein said meta-material building panel is of a thickness and pull-through ability of drywall.

5. The meta-material drywall and/or insulation building panel of claim 1, wherein each layer of said plurality of inner layers forms a closed circuit loop.

6. The meta-material drywall and/or insulation building panel of claim 5, wherein said closed circuit loop is an elliptical loop with Now curvature, low curvature being between 0.01 to 30 degrees, inclusive.

7. The meta-material drywall and/or insulation building panel of claim 5, wherein said closed circuit loop is a rectangular loop with four high curvature regions, high curvature being between 60 to 90 degrees, inclusive.

8. The meta-material drywall and/or insulation building panel of claim 1, wherein a first grouping of layers of said plurality of inner layers have an offset curves with non-zero curvature to each other and an additive inverse curvature to a second grouping of layers of said plurality of inner layers.

9. The meta-material drywall and/or insulation building panel of claim 8, wherein an object is masked from heat flux by being placed between said first grouping of layers and said second grouping of layers, each said first grouping and said second grouping having curvature in a direction away from said object.

10. The meta-material drywall and/or insulation building panel of claim 1, wherein each said inner layer comprises two equal and opposite angled high curvature regions between zero curvature regions.

11. The meta-material drywall and/or insulation building panel of claim 1, wherein said third material has a thermal conductivity of greater than pan 0.03 W/(m*K) and said fourth material has a thermal conductivity of less than 0.02 W/(m*K).

12. The meta-material drywall and/or insulation building panel of claim 1, wherein a U-value of said building panel or said insulation layer is less than 0.05.

13. The meta-material drywall and/or insulation building panel of claim 1, wherein said panel exhibits an anisotropic heat dissipation effect such that, upon said first planar side being heated, a portion of heat is conducted along a plane parallel to said first planar side with each additional inner layer.

14. A method of constructing a meta-material drywall and/or insulation building panel with an anisotropic heat dissipating effect, comprising steps of:

forming a first planar side and a second planar side parallel to said first planar side;

disposing a plurality of offset curves with non-zero curvature inner layers between and parallel to said first and second planar sides;

arranging said plurality of inner layers to alternate between a first material layer and a second material layer, each of said first material and said second material being isotropic; and selecting said first material to have a thermal conductivity greater than a thermal conductivity of said second material;

such that, upon said first planar side being heated, a majority of heat traversing each said inner layer of said first material is conducted along said offset curves with non-zero curvature of said inner layers, and a portion of heat traversing each said inner layer of said second material is conducted along a plane perpendicular to said first planar side.

15. The method of claim 14, wherein said first material has a thermal conductivity greater than 0.03 W/(m·K), said second material has a thermal conductivity less than 0.02 W/(m·K), and said plurality of inner layers is configured such that a U-value of said building panel is less than 0.05.

16. The method of claim 14, wherein each layer of said plurality of layers forms an elliptical closed circuit loop with low curvature, low curvature being between 0.01 to 30 degrees, inclusive.

17. The method of claim 14, wherein each layer of said plurality of layers forms a rectangular closed circuit loop with four high curvature regions, high curvature between 60 to 90 degrees, inclusive.

18. The method of claim 14, wherein a first grouping of layers of said plurality of inner layers have an offset curves with non-zero curvature to each other and an additive inverse curvature to a second grouping of layers of said plurality of inner layers.

19. The method of claim 18, wherein an object is masked from heat flux by being placed between said first grouping of layers and said second grouping of layers, each said first grouping and said second grouping having curvature in a direction away from said object.

20. The method of claim 14, wherein each said inner layer comprises two equal and opposite angled high curvature regions between zero curvature regions.

21. A meta-material drywall building insulation panel with an anisotropic heat dissipating effect, comprising:

a first planar side lying in a first x-y plane and a second planar side lying in a second x-y plane, said first and second x-y planes being parallel to one another and offset from one another in a z-direction; and a plurality of inner layers disposed between said first planar side and said second planar side, each said inner layer being offset from said first planar side by a unique measure in said z-direction and having a non-zero curvature;

wherein:

said plurality of inner layers alternates between a first material layer and a second material layer, each of said first material and said second material being isotropic; and upon said first planar side being heated, a majority of heat traversing each said inner layer of said first material is conducted along said non-zero curvature of said plurality of inner layers.

22. The meta-material drywall building insulation panel of claim 19, wherein said plurality of inner layers comprises at least four layers of said first material and at least four layers of said second material disposed alternatingly along said z-direction.

* * * * *